US008274345B2

(12) United States Patent
Sugisawa

(10) Patent No.: US 8,274,345 B2
(45) Date of Patent: Sep. 25, 2012

(54) ELECTROMAGNETIC RELAY

(75) Inventor: Masanao Sugisawa, Hekinan (JP)

(73) Assignee: Anden Co., Ltd., Anjo (JP)

( * ) Notice: Subject to any disclaimer, the term of this patent is extended or adjusted under 35 U.S.C. 154(b) by 188 days.

(21) Appl. No.: 12/656,650

(22) Filed: Feb. 12, 2010

(65) Prior Publication Data

US 2010/0207713 A1 Aug. 19, 2010

(30) Foreign Application Priority Data

Feb. 19, 2009 (JP) ..... 2009-036275
Mar. 31, 2009 (JP) ..... 2009-085296
May 25, 2009 (JP) ..... 2009-125182

(51) Int. Cl.
*H01F 1/00* (2006.01)

(52) U.S. Cl. ..... 335/126; 335/78

(58) Field of Classification Search ..... 335/78–86, 335/128–131, 202
See application file for complete search history.

(56) References Cited

U.S. PATENT DOCUMENTS

| | | | | |
|---|---|---|---|---|
| 6,081,176 | A * | 6/2000 | Dittmann et al. | 335/128 |
| 6,118,359 | A | 9/2000 | Dittmann et al. | |
| 7,889,032 | B2 * | 2/2011 | Parker et al. | 335/78 |
| 2002/0036557 | A1 * | 3/2002 | Nakamura et al. | 335/128 |
| 2004/0140873 | A1 * | 7/2004 | Funayama et al. | 335/128 |
| 2005/0007221 | A1 * | 1/2005 | Saruwatari et al. | 335/128 |
| 2005/0219018 | A1 | 10/2005 | Schneider et al. | |
| 2006/0226937 | A1 | 10/2006 | Takeda et al. | |
| 2006/0226938 | A1 | 10/2006 | Takeda et al. | |
| 2008/0001689 | A1 | 1/2008 | Tsutsui et al. | |

FOREIGN PATENT DOCUMENTS

| | | |
|---|---|---|
| JP | Y2-S57-14347 | 3/1982 |
| JP | A-S59-151708 | 8/1984 |
| JP | U-S61-51643 | 4/1986 |
| JP | A-S62-051126 | 3/1987 |
| JP | U-H3-44826 | 4/1991 |
| JP | U-H5-2332 | 1/1993 |
| JP | A-2008-226547 | 9/2008 |

OTHER PUBLICATIONS

Extended European Search Report issued on May 20, 2011 in the corresponding European patent application No. 10001426.5 (English translation enclosed).
Notice of Rejection mailed Jun. 14, 2011 in corresponding JP application No. 2009-125182 (and English translation).
Submission of Publication mailed Aug. 12, 2011 in corresponding JP application No. 2009-125182 (and English translation).
Notice of Rejection mailed Nov. 8, 2011 in corresponding JP application No. 2009-125182 (and English translation).
Office Action mailed May 15, 2012 issued by the US Patent Office in corresponding U.S. Appl. No. 13/307,116.

* cited by examiner

*Primary Examiner* — Bernard Rojas
(74) *Attorney, Agent, or Firm* — Posz Law Group, PLC

(57) ABSTRACT

An electromagnetic relay includes a coil, a movable member, first and second fixed contact supports each having first and second fixed contacts, and a movable body having first and second movable contacts. A third fixed contact is arranged on the second fixed contact support at a position away from a line passing through the first and second fixed contacts, and a third movable contact is arranged on the movable body. When the movable member is driven by electromagnetic force of the coil, the movable contacts contact the fixed contacts at a contact portion between the first fixed contact and the first movable contact, a contact portion between the second fixed contact and the second movable contact, and a contact portion between the third fixed contact and the third movable contact.

7 Claims, 14 Drawing Sheets

ELECTROMAGNETIC RELAY

CROSS REFERENCE TO RELATED APPLICATION

The present application is based on Japanese Patent Applications No. 2009-36275 filed on Feb. 19, 2009, No. 2009-85296 filed on Mar. 31, 2009, and No. 2009-125182 filed on May 25, 2009, the disclosures of which are incorporated herein by reference.

FIELD OF THE INVENTION

The present invention relates to an electromagnetic relay that opens and closes an electrical circuit.

BACKGROUND OF THE INVENTION

In a conventional electromagnetic relay described in JP-A-2008-226547, two fixed contact supports having two fixed contacts respectively are positioned, and two movable contacts are contacted by and separated from the two fixed contacts by moving one movable body, to which the two movable contacts are fixed, so that an electrical circuit is opened and closed. More specifically, the electromagnetic relay includes a movable member driven by electromagnetic force of a coil, a pressure spring for urging the movable body such that the movable contacts contact the fixed contacts, a return spring for urging the movable body via the movable member such that the movable contacts are separated from the fixed contacts, and the like. Further, a contact surface between the movable contacts and the fixed contacts is a spherical surface.

When the coil is energized, the movable member is driven toward a side away from the movable body by the electromagnetic force, and the movable body is urged by the pressure spring to be moved. As a result, the movable contacts contact the fixed contacts, and the movable member is separated from the movable body.

In a conventional electromagnetic relay described in JP-A-62-51126, two fixed contact supports having two fixed contacts respectively are positioned, and two movable contacts are contacted by and separated from the two fixed contacts by moving one movable body, to which the two movable contacts are fixed, so that an electrical circuit is opened and closed. More specifically, the movable body is integrated with a movable member that is driven by electromagnetic force of a coil such that the movable body can be relatively moved, the movable body is held at a predetermined position of the movable member by a pressure spring, and the movable member and the movable body are urged by a return spring such that the movable contacts are separated from the fixed contacts. Further, a contact surface between the movable contacts and the fixed contacts is a spherical surface.

When the coil is energized, the movable member and the movable body are driven by the electromagnetic force and the movable contacts contact the fixed contacts. At this time, the pressure spring is bent by a stroke of the movement of the movable member after the movable contacts contact the fixed contacts, thereby the movable member and the movable body are relatively moved.

However, in the electromagnetic relay described in JP-A-2008-226547, because the contact surface is a spherical surface, the movable contacts contact the fixed contacts by point contact. When the coil is energized, the movable contacts contact the fixed contacts by two-points contact, that is, at a first contact portion between one fixed contact and one movable contact, and a second contact portion between the other fixed contact and the other movable contact. In this manner, because the movable contacts contact the fixed contacts by the point contact, i.e., the two-points contact, the movable body may vibrate around a line passing through the first and second contact portions when the movable contacts collide with the fixed contacts. In particular, in the electromagnetic relay described in JP-A-2008-226547, because the movable member is separated from the movable body when the movable contacts contact the fixed contacts, the vibration suppression effect by the movable member cannot be obtained, and thereby it becomes difficult to suppress the vibration of the movable body. Thus, the vibration of the movable body may be resonated in a casing to generate abnormal noise.

In the electromagnetic relay described in JP-A-62-51126, because the movable body is integrated with the movable member, it is easy to suppress vibration of the movable body when the movable contacts collide with the fixed contacts. However, a position of a contact portion is changed in accordance with the vibration of the movable body until the vibration of the movable body is suppressed. Thus, a resistance value between the contacts is changed, and thereby it becomes easy for the contact portion to generate heat and the wear-and-tear of the contacts may occur.

SUMMARY OF THE INVENTION

In view of the above points, it is an object of the present invention to provide an electromagnetic relay that restricts the abnormal noise and the wear-and-tear of contacts due to the vibration of a movable body.

According to a first aspect of the present invention, an electromagnetic relay includes a coil configured to generate an electromagnetic force when the coil is energized; a movable member configured to be driven by the electromagnetic force of the coil; two fixed contact supports having two fixed contacts, respectively; a movable body having two movable contacts configured to contact and be separated from the fixed contacts, respectively; a pressure, spring configured to urge the movable body such that the movable contacts contact the fixed contacts, respectively; a return spring configured to urge the movable body via the movable member such that the movable contacts are separated from the fixed contacts, respectively; a fixed-side contact member fixed to a predetermined position; and a movable-side contact member arranged on the movable body. The movable contacts contact the fixed contacts and the movable member is separated from the movable body when the movable member is driven by the electromagnetic force of the coil. The movable-side contact member is configured to contact the fixed-side contact member when the movable contacts contact the fixed contacts. The fixed-side contact member is arranged away from a line passing through the two fixed contacts. The movable-side contact member is arranged away from a line passing through the two movable contacts.

According to the above configuration, when the movable member is driven by the electromagnetic force of the coil, the two movable contacts and the movable-side contact member contact the two fixed contacts and the fixed-side contact member by three-points contact, that is, at a contact portion between one of the fixed contacts and one of the movable contacts, a contact portion between the other of the fixed contacts and the other of the movable contacts, and a contact portion between the fixed-side contact member and the movable-side contact member. Therefore, the vibration of the movable body caused when the movable contacts collide with the fixed contacts, and thereby the abnormal noise due to the vibration of the movable body and the wear-and-tear of the contacts can be restricted.

According to a second aspect of the present invention, an electromagnetic relay includes a coil configured to generate an electromagnetic force when the coil is energized; a movable member configured to be driven by the electromagnetic force of the coil; a first fixed contact support having a first fixed contact; a second fixed contact support having a second fixed contact; a movable body having a first movable contact configured to contact and be separated from the first fixed contact and a second movable contact configured to contact and be separated from the second fixed contact; a pressure spring configured to urge the movable body such that the first movable contact contacts the first fixed contact and the second movable contact contacts the second fixed contact; a return spring configured to urge the movable body via the movable member such that the first movable contact is separated from the first fixed contact and the second movable contact is separated from the second fixed contact; a first magnet arranged lateral to the first fixed contact and the first movable contact, the first magnet being configured to act Lorentz force on an arc generated between the first fixed contact and the first movable contact; a second magnet arranged lateral to the second fixed contact and the second movable contact, the second magnet being configured to act Lorentz force on an arc generated between the second fixed contact and the second movable contact; a third fixed contact fixed to the second fixed contact support; and a third movable contact arranged on the movable body. The first and second movable contacts contact the first and second fixed contacts and the movable member is separated from the movable body when the movable member is driven by the electromagnetic force of the coil. The third movable contact is configured to contact the third fixed contact when the movable member is driven by the electromagnetic force of the coil. The third fixed contact is arranged away from a line passing through the first fixed contact and the second fixed contact. The third movable contact is arranged away from a line passing through the first movable contact and the second movable contact. A distance from the second magnet to the third fixed contact and the third movable contact is longer than a distance from the second magnet to the second fixed contact and the second movable contact. A portion of the movable member, which contacts the movable body, is a movable-member end surface, and a portion of the movable body, which contacts the movable-member end surface, is a movable-body pressing surface. The movable-member end surface is inclined with respect to the movable-body pressing surface when the first to third movable contacts contact the first to third fixed contacts such that the second movable contact is separated from the second fixed contact after, the third movable contact is separated from the third fixed contact when the coil is de-energized and the movable member is driven by an urging force of the return spring.

According to a third aspect of the present invention, an electromagnetic relay includes a coil configured to generate an electromagnetic force when the coil is energized; a movable member configured to be driven by the electromagnetic force of the coil; a first fixed contact support having a first fixed contact; a second fixed contact support having a second fixed contact; a movable body having a first movable contact configured to contact and be separated from the first fixed contact and a second movable contact configured to contact and be separated from the second fixed contact; a pressure spring configured to urge the movable body such that the first movable contact contacts the first fixed contact and the second movable contact contacts the second fixed contact; a return spring configured to urge the movable body via the movable member such that the first movable contact is separated from the first fixed contact and the second movable contact is separated from the second fixed contact; a first magnet arranged lateral to the first fixed contact and the first movable contact, the first magnet being configured to act Lorentz force on an arc generated between the first fixed contact and the first movable contact; a second magnet arranged lateral to the second fixed contact and the second movable contact, the second magnet being configured to act Lorentz force on an arc generated between the second fixed contact and the second movable contact; a third fixed contact fixed to the second fixed contact support; and a third movable contact arranged on the movable body. The first and second movable contacts contact the first and second fixed contacts and the movable member is separated from the movable body when the movable member is driven by the electromagnetic force of the coil. The third movable contact is configured to contact the third fixed contact when the movable member is driven by the electromagnetic force of the coil. The third fixed contact is arranged away from a line passing through the first fixed contact and the second fixed contact. The third movable contact is arranged away from a line passing through the first movable contact and the second movable contact. A distance from the second magnet to the third fixed contact and the third movable contact is longer than a distance from the second magnet to the second fixed contact and the second movable contact. A portion of the movable member, which contacts the movable body, is a movable-member end surface, and a portion of the movable body, which contacts the movable-member end surface, is a movable-body pressing surface. The movable-body pressing surface has a protrusion that protrudes toward the movable-member end surface such that the second movable contact is separated from the second fixed contact after the third movable contact is separated from the third fixed contact when the coil is de-energized and the movable member is driven by an urging force of the return spring.

According to the above configurations, when the movable member is driven by the electromagnetic force of the coil, the first to third movable contacts contact the first to third fixed contacts by three-points contact. Therefore, the vibration of the movable body caused when the first to third movable contacts collide with the first to third fixed contacts, and thereby the abnormal noise due to the vibration of the movable body and the wear-and-tear of the contacts can be restricted.

Further, in a contact portion between the second fixed contact and the second movable contact and a contact portion between the third fixed contact and the third movable contact, an arc is generated at one contact portion, at which one movable contact is moved away from one fixed contact later. Because the second movable contact is moved away from the second fixed contact later, an arc is generated between the second fixed contact and the second movable contact. The second fixed contact and the second movable contact are closer to the second magnet than the third fixed contact and the third movable contact, and the arc can be extinguished entirely.

According to a fourth aspect of the present invention, an electromagnetic relay includes a case; a coil configured to generate an electromagnetic force when the coil is energized; a movable member configured to be driven by the electromagnetic force of the coil; a plate-like first fixed contact support; a plate-like second fixed contact support; a plate-like movable body configured to contact and be separated from the first and second fixed contact supports; a pressure spring configured to urge the movable body such that the movable body contacts the first and second fixed contact supports; and a return spring configured to urge the movable body via the movable member such that the movable body is separated from the first and second fixed contact supports. The movable body contacts the first fixed contact support at a first contact portion, the movable body contacts the second fixed contact support at a second contact portion, and the movable member is separated from the movable body when the movable member is driven by the electromagnetic force of the coil. The movable body contacts the case and at least one of the first and second fixed contact supports at a third contact portion by a point contact when the movable body contacts the first and second fixed contact supports. The third contact portion is arranged away from a line passing through the first contact portion and the second contact portion.

According to the above configuration, when the movable member is driven by the electromagnetic force of the coil, the movable body contacts the fixed contact supports by three-points contact. Therefore, the vibration of the movable body caused when the movable body collides with the fixed contact supports, and thereby the abnormal noise due to the vibration of the movable body can be restricted.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Figure 1:
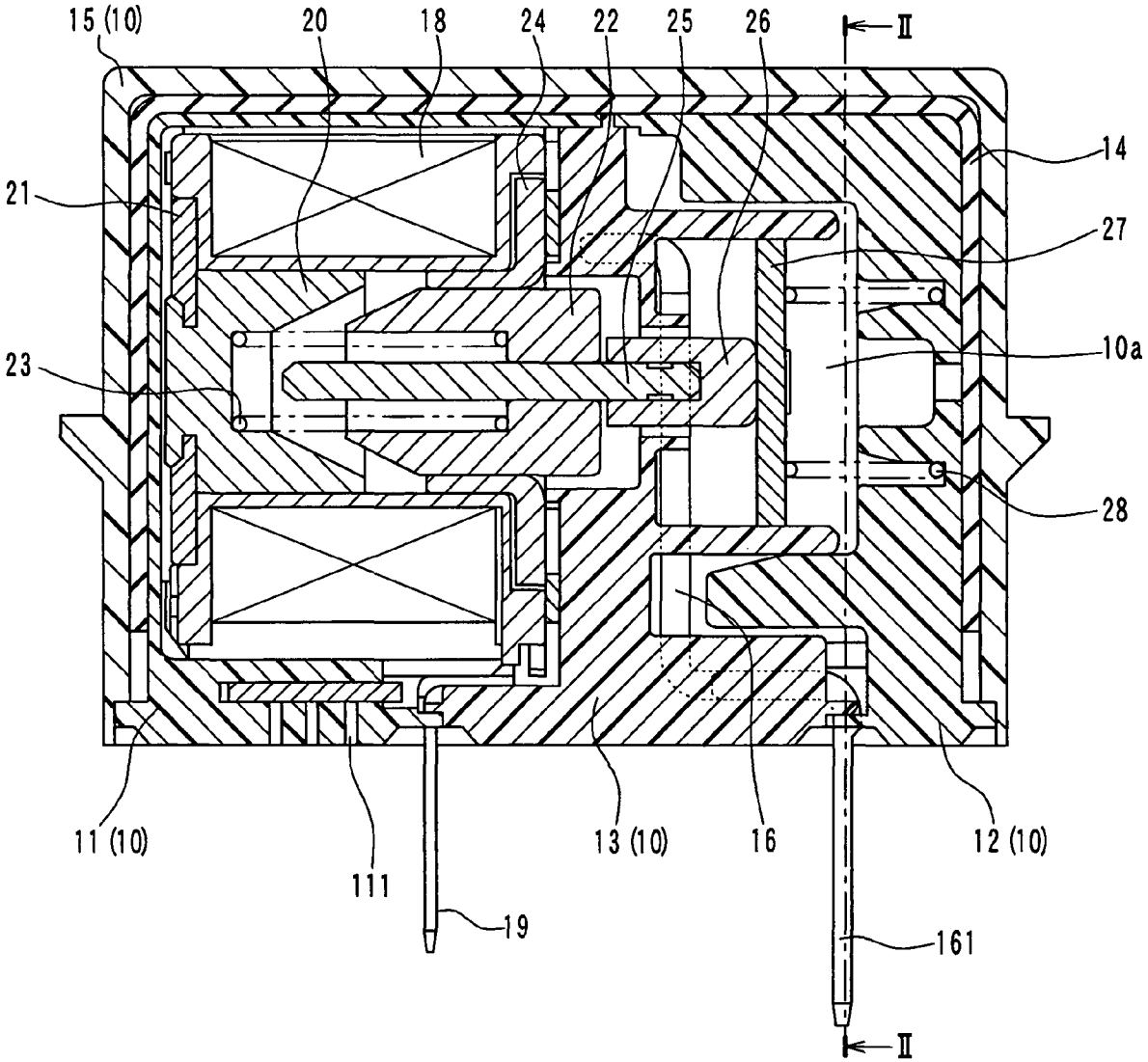
FIG. 1 is a cross-sectional view showing an electromagnetic relay according to a first embodiment of the present invention.

Hereinafter, embodiments of the present invention will be described with reference to accompanying drawings. In the following embodiments, components of one embodiment, which are similar to the components of the other embodiment, will be designated by the same reference numerals.

(First Embodiment)

Figure 2:
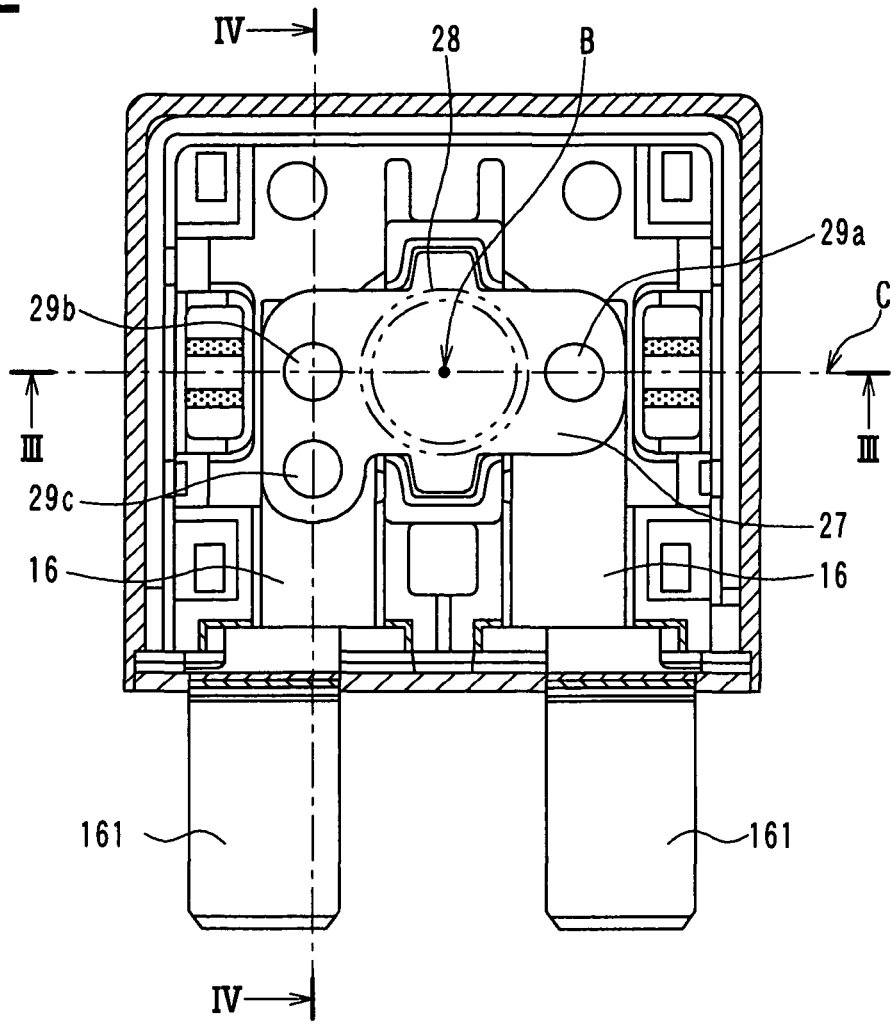
FIG. 2 is a cross-sectional view taken along a line II-II in FIG. 1.

As shown in FIGS. 1 and 2, an electromagnetic relay of the present embodiment has a resin case 10 having a rectangular parallelepiped shape, and the case 10 includes a first case 11, a second case 12, a third case 13, and a resin cover 15. The first case 11 has a tubular shape with a bottom, and the second case 12 has a tubular shape with a bottom. The third case 13 is provided between the first case 11 and the second case 12. The resin cover 15 has a tubular shape with a bottom. The first case 11 is provided with multiple ventilation holes 111. The case 10 has a housing space 10*a* therein, and the housing space 10*a* communicates with the external space outside the case 10 through the multiple ventilation holes 111.

The resin cover 15 has a rubber cover 14 therein. The rubber cover 14 is fitted into the resin cover 15 so as to limit noise and vibration. Both the rubber cover 14 and the resin cover 15 have rectangular parallelepiped shape. Each of the rubber cover 14 and the resin cover 15 has an opening at one end and a bottom at the other end. The case 10 has five faces that are not provided with the ventilation holes 111, and the five faces are covered by the rubber cover 14 and the resin cover 15.

The third case 13 has two fixed contact supports 16 fixed thereto. The fixed contact supports 16 are made of conductive metal. Each of the fixed contact supports 16 extends through the case 10 and has one end positioned within the housing space 10*a* and has the other end positioned at the external space outside the case 10. It should be noted that configurations of the two fixed contact supports 16 are different each other as described below. In the following embodiments, as necessary, one of the fixed contact supports 16 will be referred to as a first fixed contact support 16*a*, and the other thereof will be referred to as a second fixed contact support 16*b*.

The other end of each of the fixed contact supports 16 in the external space is provided with a load circuit terminal 161 that is connected to an external harness (not shown). The load circuit terminal 161 of one of the fixed contact supports 16 is connected to a power source (not shown) through the external harness, and the load circuit terminal 161 of the other one of the fixed contact supports 16 is connected to an electrical load (not shown) through the external harness.

Figure 3:
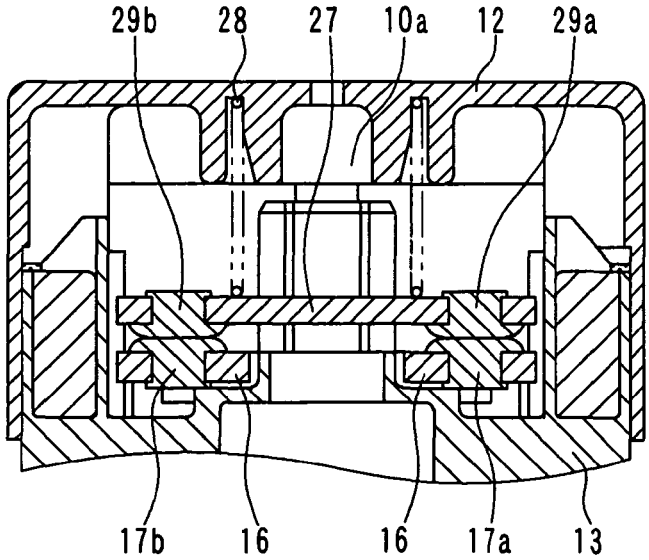
FIG. 3 is a cross-sectional view taken along a line III-III in FIG. 2.
Figure 4:
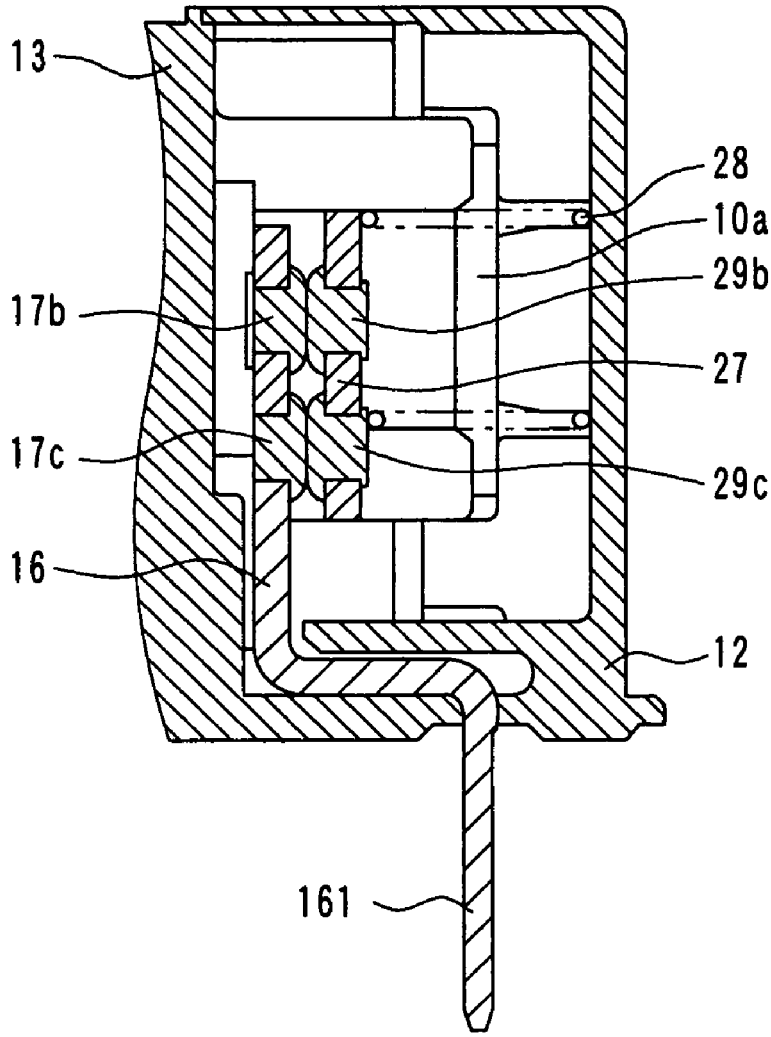
FIG. 4 is a cross-sectional view taken along a line IV-IV in FIG. 2.
Figure 5:
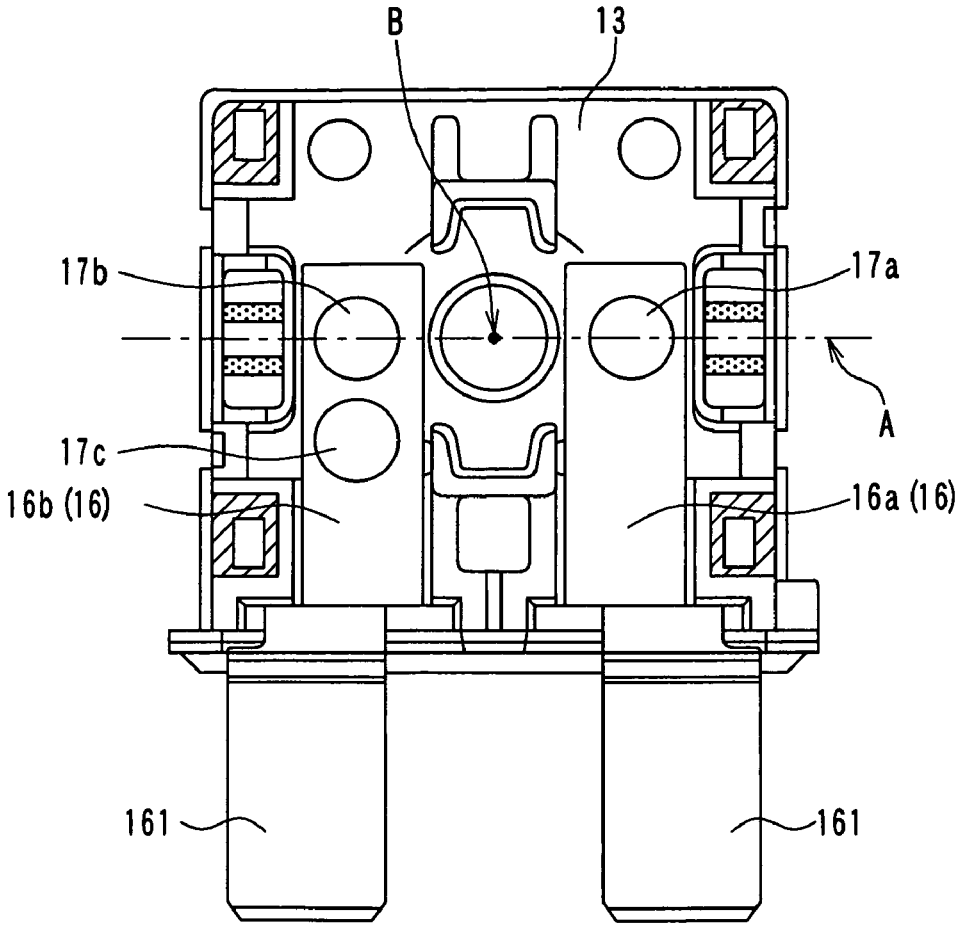
FIG. 5 is a cross-sectional view showing components integrated with a third case of FIG. 1.

As shown in FIGS. 3 to 5, the one end of the first fixed contact support 16*a* within the housing space 10*a* is caulk-fixed to a first fixed contact 17*a* made of conductive metal. The one end of the second fixed contact support 16*b* within the housing space 10*a* is caulk-fixed to a second fixed contact 17*b* and a third fixed contact 17*c*, each of which is made of conductive metal. The third fixed contact 17*c* corresponds to a fixed-side contact member of the present invention.

A line passing through the center of the first fixed contact 17*a* and the center of the second fixed contact 17*b* is referred to as a fixed-contact center-connecting line A. When viewed in a moving direction of a movable body 27 (i.e., the state shown in FIG. 5), the first and second fixed contacts 17*a*, 17*b* are arranged such that the fixed-contact center-connecting line A passes through a gravity center B of force of a pressure spring 28, which acts on the movable body 27, and the first and second fixed contacts 17*a*, 17*b* are located on both sides of the gravity center B. Further, when viewed in the moving direction of the movable body 27, the third fixed contact 17*c* is arranged away from the fixed-contact center-connecting line A.

As shown in FIGS. 1 and 2, the first case 11 has therein a cylindrical coil 18 that generates electromagnetic force when the coil 18 is energized. The coil 18 is connected to two coil terminals 19 that are made of conductive metal. One end of each of the coil terminals 19 extends to an exterior of the case 10, and is connected to an ECU (not shown) through the external harness. The coil 18 is configured to be energized through the external harness and the coil terminals 19.

A fixed core 20 made of magnetic metal is arranged at a position radially inward of the coil 18. A yoke 21 made of magnetic metal is arranged at one longitudinal end of the coil 18 and at a position radially outward of the coil 18. Both ends of the yoke 21 are fitted to the second case 12 so that the yoke 21 is fixed to the second case 12. The fixed core 20 is supported by the yoke 21.

A movable core 22 made of magnetic metal is arranged at a position radially inward of the coil 18 and within the third case 13 such that the movable core 22 is opposed to the fixed core 20. A return spring 23 is arranged between the fixed core 20 and the movable core 22 such that the return spring 23 urges the movable core 22 toward a side away from the fixed core 20. When the coil 18 is energized, the movable core 22 is attracted toward the fixed core 20 against the urging force of the return spring 23.

A flanged cylindrical plate 24 made of magnetic metal is arranged at the other longitudinal end of the coil 18. The plate 24 slidably holds the movable core 22. The fixed core 20, the yoke 21, the movable core 22, and the plate 24 form a magnetic circuit of a magnetic flux induced by the coil 18.

A shaft 25 made of metal penetrates the movable core 22 and is fixed to the movable core 22. The shaft 25 has one end portion that extends to be placed within the third case 13. The one end portion of the shaft 25 is fitted with and fixed to an electrical insulator 26 made of resin having an electrical insulation property. The electrical insulator 26 is located within the third case 13. The movable core 22, the shaft 25 and the electrical insulator 26 correspond to a movable member of the present invention.

The plate-like movable body 27 made of conductive metal is arranged within the third case 13. The pressure spring 28 is arranged between the movable body 27 and the second case 12. The pressure spring 28 urges the movable body 27 toward the shaft 25.

The movable body 27 is caulk-fixed to a first movable contact 29*a* made of conductive metal at a position opposed to the first fixed contact 17*a*, and is caulk-fixed to a second movable contact 29*b* made of conductive metal at a position opposed to the second fixed contact 17*b*. Further, the movable body 27 is caulk-fixed to a third movable contact 29*c* made of conductive metal at a position opposed to the third fixed contact 17*c*. The third movable contact 29*c* corresponds to a movable-side contact member of the present invention.

When the movable core 22 and the like are driven toward the fixed core 20 by the electromagnetic force, the three movable, contacts 29*a* to 29*c* contact the three fixed contacts 17*a* to 17*c*. A contact portion between the first fixed contact 17*a* and the first movable contact 29*a* corresponds to a first contact portion of the present invention. A contact portion between the second fixed contact 17*b* and the second movable contact 29*b* corresponds to a second contact portion of the present invention. A contact portion between the third fixed contact 17*c* and the third movable contact 29*c* corresponds to a third contact portion of the present invention.

A line passing through the center of the first movable contact 29*a* and the center of the second movable contact 29*b* is referred to as a movable-contact center-connecting line C. When viewed in the moving direction of the movable body 27 (i.e., the state shown in FIG. 2), the first and second movable contacts 29*a*, 29*b* are arranged such that the movable-contact center-connecting line C passes through the gravity center B of force of the pressure spring 28, and the first and second movable contacts 29*a*, 29*b* are located on both sides of the gravity center B. Further, when viewed in the moving direction of the movable body 27, the third movable contact 29*c* is arranged away from the movable-contact center-connecting line C.

In other words, when viewed in the moving direction of the movable body 27, the third contact portion is away from a line passing through the first contact portion and the second contact portion, that is, the fixed-contact center-connecting line A and the movable-contact center-connecting line C.

Further, in order to reduce resistance of the contact portions between each of the fixed contacts 17*a* to 17*c* and each of the movable contacts 29*a* to 29*c*, the fixed contacts 17*a* to 17*c* and the movable contacts 29*a* to 29*c* are made of material having lower electric resistance than the fixed contact supports 16 and the movable body 27.

Next, operation of the electromagnetic relay of the present embodiment will be described. Firstly, when the coil 18 is energized, the electromagnetic force attracts the movable core 22, the shaft 25 and the electrical insulator 26 toward the fixed core 20 against the force of the return spring 23, and thereby the movable body 27 is urged by the pressure spring 28 so that the movable body 27 is displaced to follow the movable core 22 and the like. As a result, the three movable contacts 29*a* to 29*c* contact the three fixed contacts 17*a* to 17*c*, respectively, thereby establishing the conduction between the two load circuit terminals 161. After the three movable contacts 29*a* to 29*c* contact the three fixed contacts 17*a* to 17*c*, the movable core 22 and the like are displaced toward the fixed core 20 and the electrical insulator 26 is separated from the movable body 27.

When the movable core 22 and the like are driven toward the fixed core 20 by the electromagnetic force, the movable contacts 29*a* to 29*c* contact the fixed contacts 17*a* to 17*c* by three-points contact, that is, at the contact portion between the first fixed contact 17*a* and the first movable contact 29*a*, the contact portion between the second fixed contact 17*b* and the second movable contact 29*b*, and the contact portion between the third fixed contact 17*c* and the third movable contact 29*c*. Therefore, vibration of the movable body 27 caused when the movable contacts 29*a* to 29*c* collide with the fixed contacts 17*a* to 17*c* can be restricted.

In contrast, when the coil 18 is de-energized, the return spring 23 urges the movable body 27, the movable core 22 and the like toward the side away from the fixed core 20 against the urging force of the pressure spring 28. As a result, the three movable contacts 29*a* to 29*c* are separated from the three fixed contacts 17*a* to 17*c*, thereby the conduction between the two load circuit terminals 161 is disabled.

As described above, according to the present embodiment, when the movable core 22 and the like are driven toward the fixed core 20, the three movable contacts 29*a* to 29*c* contact the three fixed contacts 17*a* to 17*c* by the three-points contact, thereby the vibration of the movable body 27 caused when the three movable contacts 29*a* to 29*c* collide with the three fixed contacts 17*a* to 17*c* can be restricted. Therefore, the abnormal noise due to the vibration of the movable body 27 and the wear-and-tear of the contacts 17*a* to 17*c* and 29*a* to. 29*c* can be restricted.

(Second Embodiment)

In the present embodiment, the arrangement of the three movable contacts 29*a* to 29*c* and the three fixed contacts 17*a* to 17*c* is modified. Because the other configuration of the present embodiment is the same with that of the first embodiment, only the difference will be described.

Figure 6:
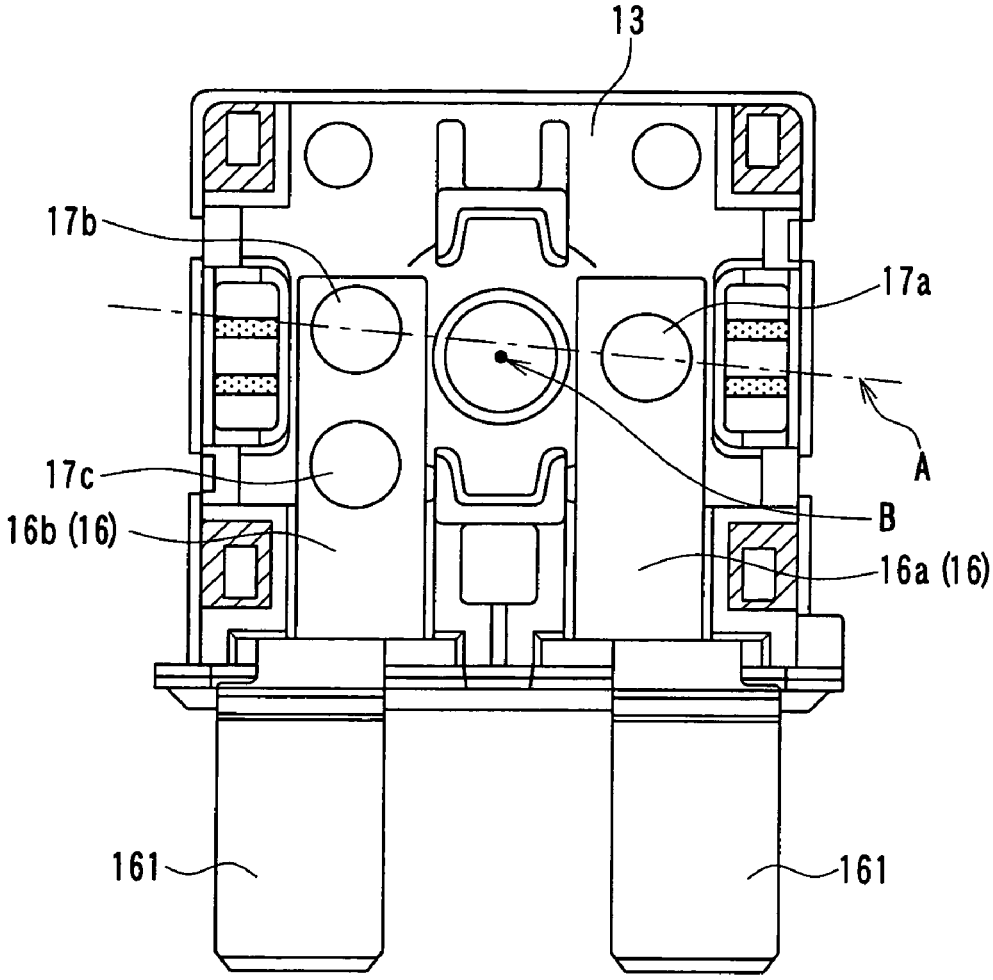
FIG. 6 is a cross-sectional view showing an electromagnetic relay according to a second embodiment of the present invention.

As shown in FIG. 6, when viewed in the moving direction of the movable body 27 (i.e., the state shown in FIG. 6), the first and second fixed contacts 17*a*, 17*b* are arranged such that the fixed-contact center-connecting line A does not pass through the gravity center B. Further, when viewed in the moving direction of the movable body 27, the three fixed contacts 17*a* to 17*c* are arranged such that the gravity center B is located in a region of a triangle formed by connecting the centers of each of the three fixed contacts 17*a* to 17*c*.

Figure 7:
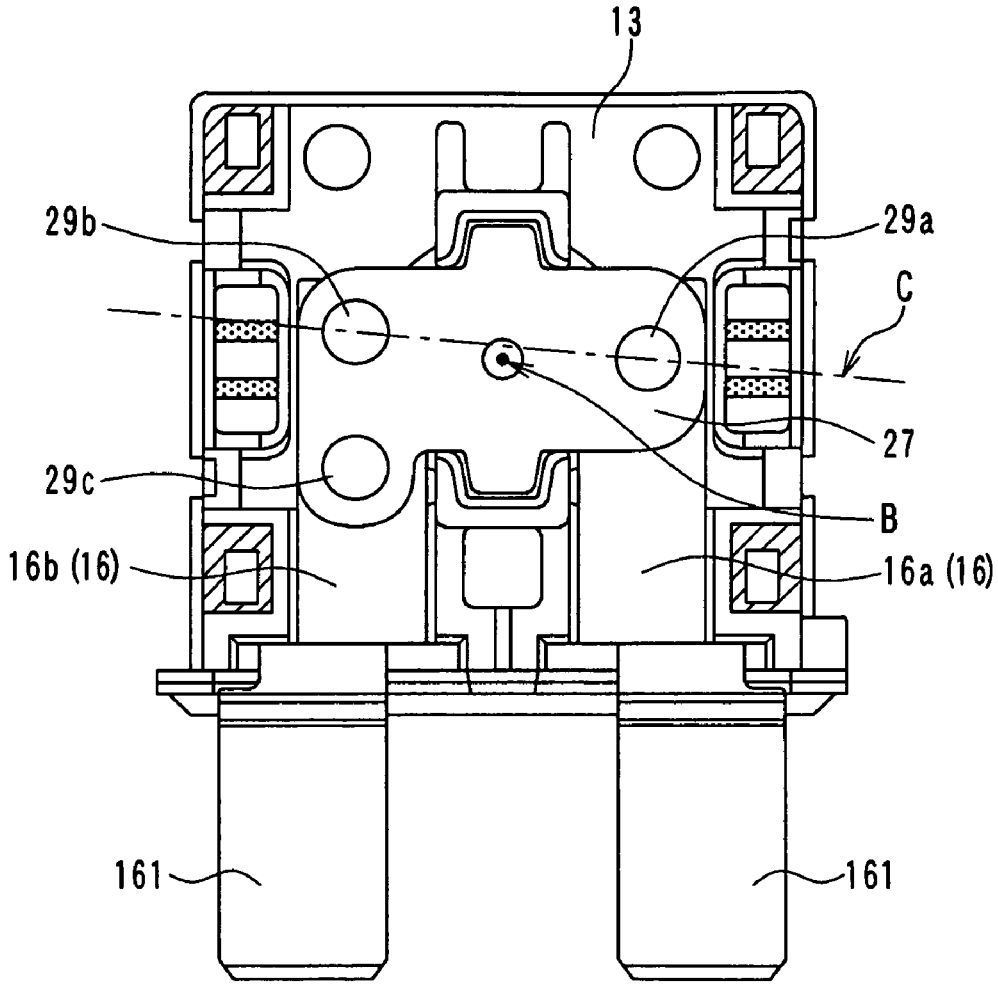
FIG. 7 is a cross-sectional view showing the electromagnetic relay of FIG. 6 with a movable body.

As shown in FIG. 7, on the movable body 27, the first movable contact 29*a* is arranged at a position opposed to the first fixed contact 17*a*, the second movable contact 29*b* is arranged at a position opposed to the second fixed contact 17*b*, and the third movable contact 29*c* is arranged at a position opposed to the third fixed contact 17*c*. In other words, when viewed in the moving direction of the movable body 27 (i.e., the state shown in FIG. 7), the first and second movable contacts 29*a*, 29*b* are arranged such that the movable-contact center-connecting line C does not pass through the gravity center B. Further, when viewed in the moving direction of the movable body 27, the three movable contacts 29*a* to 29*c* are arranged such that the gravity center B is located in a region of a triangle formed by connecting the centers of each of the three movable contacts 29*a* to 29*c*.

By arranging the three movable contacts 29*a* to 29*c* and the three fixed contacts 17*a* to 17*c* as described above, the vibration of the movable body 27 caused when the three movable contacts 29*a* to 29*c* collide with the three fixed contacts 17*a* to 17*c* can be restricted more reliably.

(Third Embodiment)

In the present embodiment, a magnet is arranged lateral to the movable contact and the fixed contact. By acting Lorentz force on an arc generated when the movable contact is moved away from the fixed contact, the arc is extended to be cut off. Because the other configuration of the present embodiment is the same with that of the first embodiment, only the difference will be described.

Figure 8:
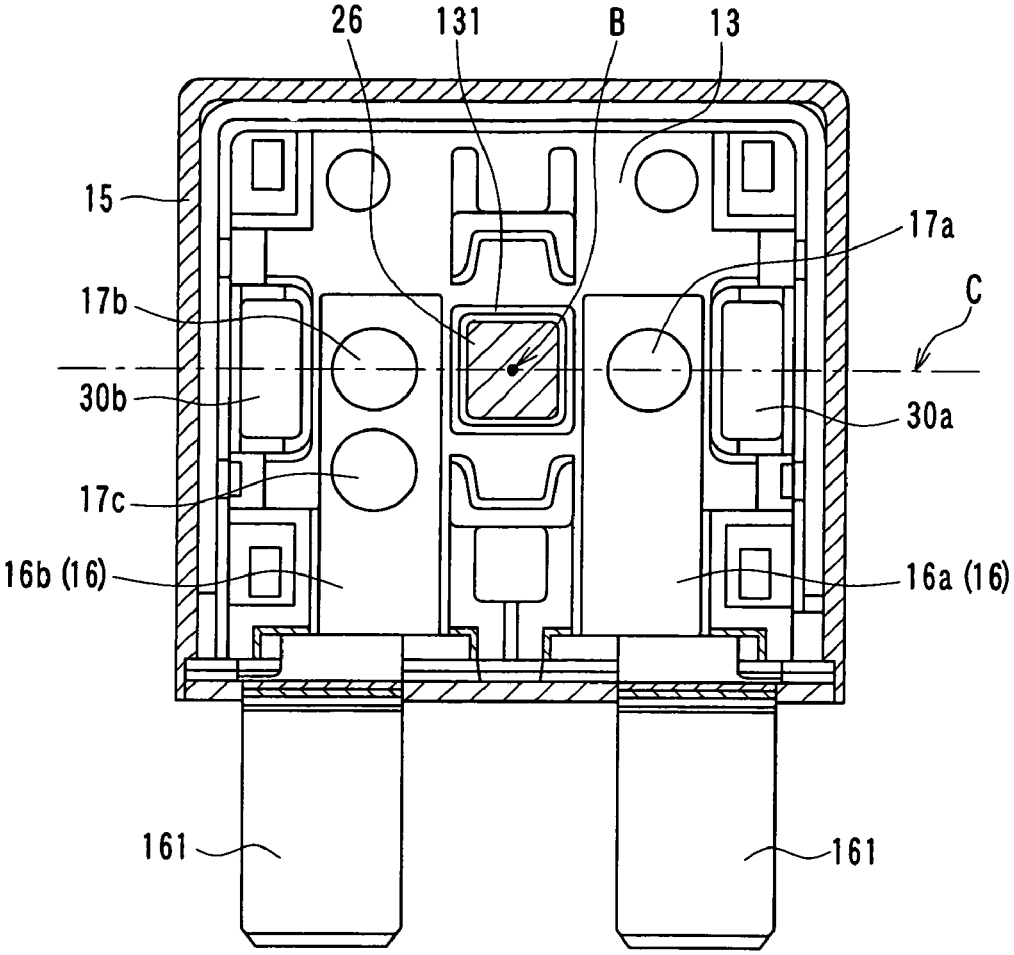
FIG. 8 is a cross-sectional view showing an electromagnetic relay according to a third embodiment of the present invention.
Figure 9:
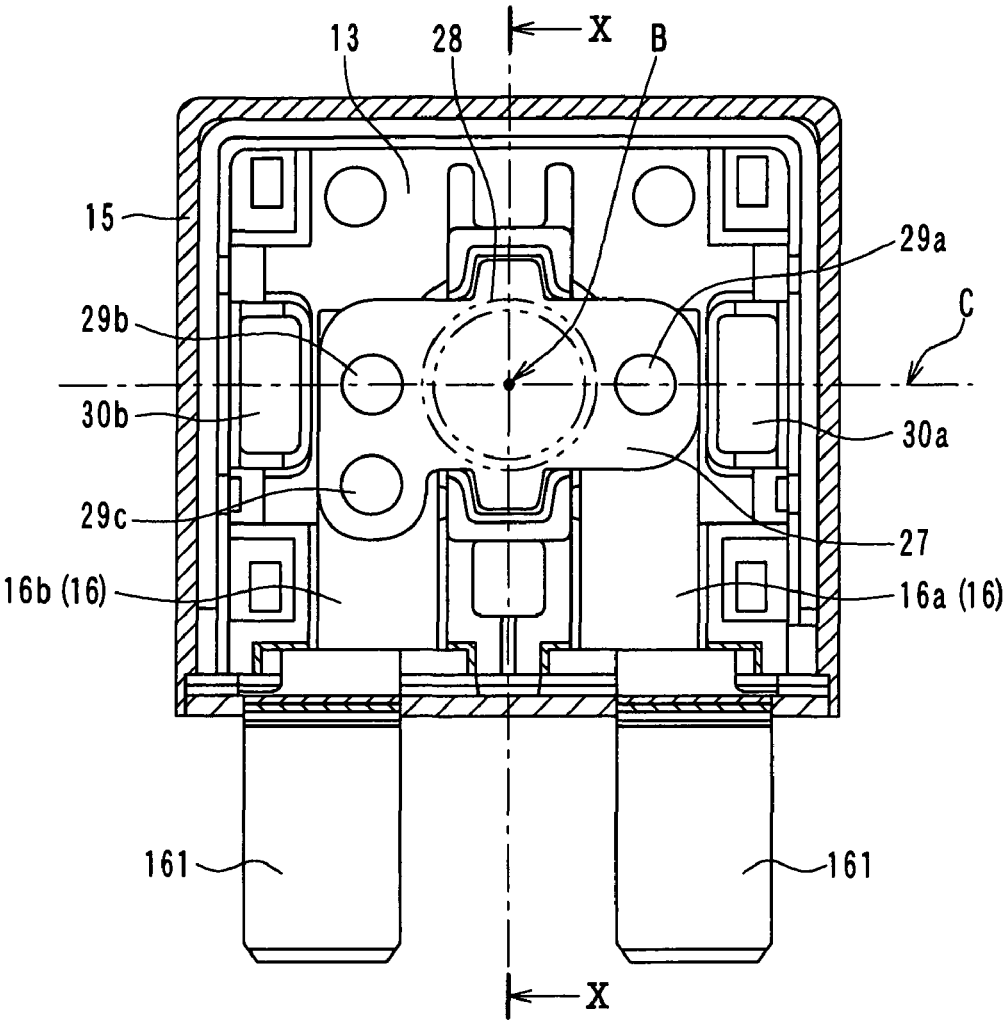
FIG. 9 is a cross-sectional view showing the electromagnetic relay of FIG. 8 with a movable body.

As shown in FIGS. 8 and 9, a first permanent magnet 30*a* is arranged lateral to the first fixed contact 17*a* and the first movable contact 29*a*. The first permanent magnet 30*a* is configured to act Lorentz force on an arc generated when the first movable contact 29*a* is moved away from the first fixed contact 17*a*. Further, a second permanent magnet 30*b* is arranged lateral to the second fixed contact 17*b* and the second movable contact 29*b*. The second permanent magnet 30*b* is configured to act Lorentz force on an arc generated when the second movable contact 29*b* is moved away from the second fixed contact 17*b*.

More specifically, when viewed in the moving direction of the movable body 27 (i.e., the states shown in FIGS. 8 and 9), the first and second permanent magnets 30*a*, 30*b* are arranged so as to be located on an extended line from the movable-contact center-connecting line C. Each of the first and second permanent magnets 30*a*, 30*b* is formed to be a cylindrical shape, and is inserted into a concave portion formed in a side wall of the third case 13.

A distance from the second permanent magnet 30*b* to the third fixed contact 17*c* and the third movable contact 29*c* is longer than a distance from the second permanent magnet 30*b* to the second fixed contact 17*b* and the second movable contact 29*b*. Thus, it is difficult to act Lorentz force by the second permanent magnet 30*b* on an arc generated between the third movable contact 29*c* and the third fixed contact 17*c*, and thereby it is difficult to extinguish the arc entirely.

Figure 10:
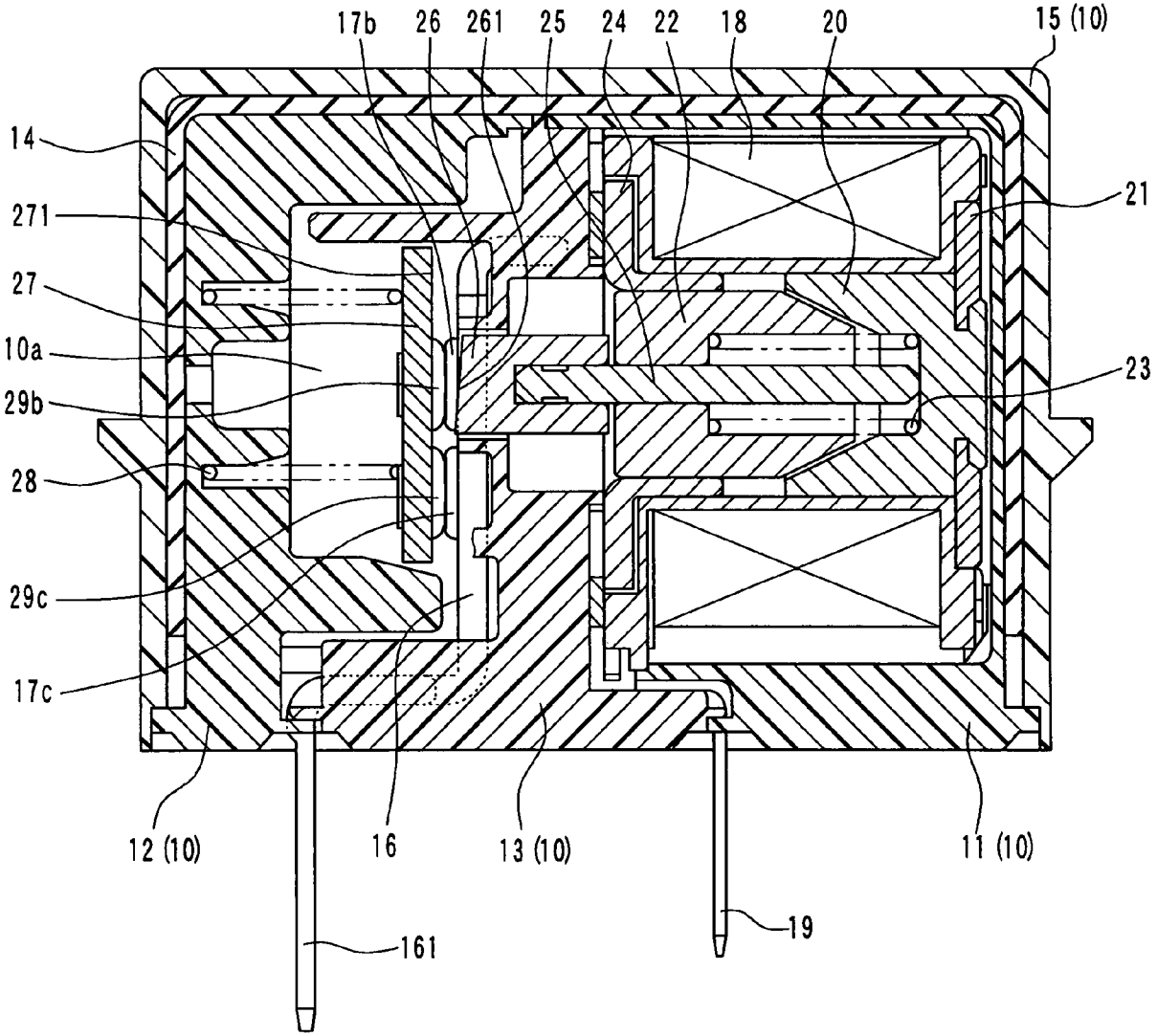
FIG. 10 is a cross-sectional view taken along a line X-X in FIG. 9 when a movable contact contacts a fixed contact.

In order to extinguish the arc entirely, the following configuration is applied in the present embodiment. As shown in FIG. 10, an end surface of the electrical insulator 26, which contacts the movable body 27, is referred to as a movable-member end surface 261, and a surface of the movable body 27, which contacts the movable-member end surface 261, is referred to as a movable-body pressing surface 271. The movable-member end surface 261 is inclined with respect to the movable-body pressing surface 271 in a contact-portion closed state (i.e, in a coil-energized state), that is, when the first to third movable contacts 29*a* to 29*c* contact the first to third fixed contacts 17*a* to 17*c*.

More specifically, in the contact-portion closed state, the movable-member end surface 261 at a side of the third fixed contact 17*c* is closer to the movable-body pressing surface 271 than that at a side of the second fixed contact 17*b* in an arrangement direction of the second fixed contact 17*b* and the third fixed contact 17*c*, that is, in an arrangement direction of the second movable contact 29*b* and the third movable contact 29*c* (i.e., an up-down direction on the paper plane of FIGS. 8 to 11).

As shown in FIG. 8, a cross-sectional shape of the electrical insulator 26 is a rectangular shape, and a cross-sectional shape of an opening of a guide portion 131 that guides the electrical insulator 26 within the third case 13 is also a rectangular shape. Thus, rotation of the electrical insulator 26 can be restricted.

Next, operation of the electromagnetic relay of the present embodiment will be described. Firstly, when the coil 18 is energized, the three movable contacts 29*a* to 29*c* contact the three fixed contacts 17*a* to 17*c*, respectively. After that, the movable core 22 and the like are displaced toward the fixed core 20 and the electrical insulator 26 is separated from the movable body 27 as shown in FIG. 10.

In contrast, when the coil 18 is de-energized, the return spring 23 urges the movable core 22, the electrical insulator 26 and the like toward the side away from the fixed core 20. At this time, the movable-member end surface 261 at the side of the third fixed contact 17*c* contacts the movable-body pressing surface 271 firstly in the arrangement direction of the second fixed contact 17*b* and the third fixed contact 17*c*. Then, the movable-member end surface 261 presses the movable-body pressing surface 271, and thereby the movable body 27 is inclined in accordance with the movable-member end surface 261.

Figure 11:
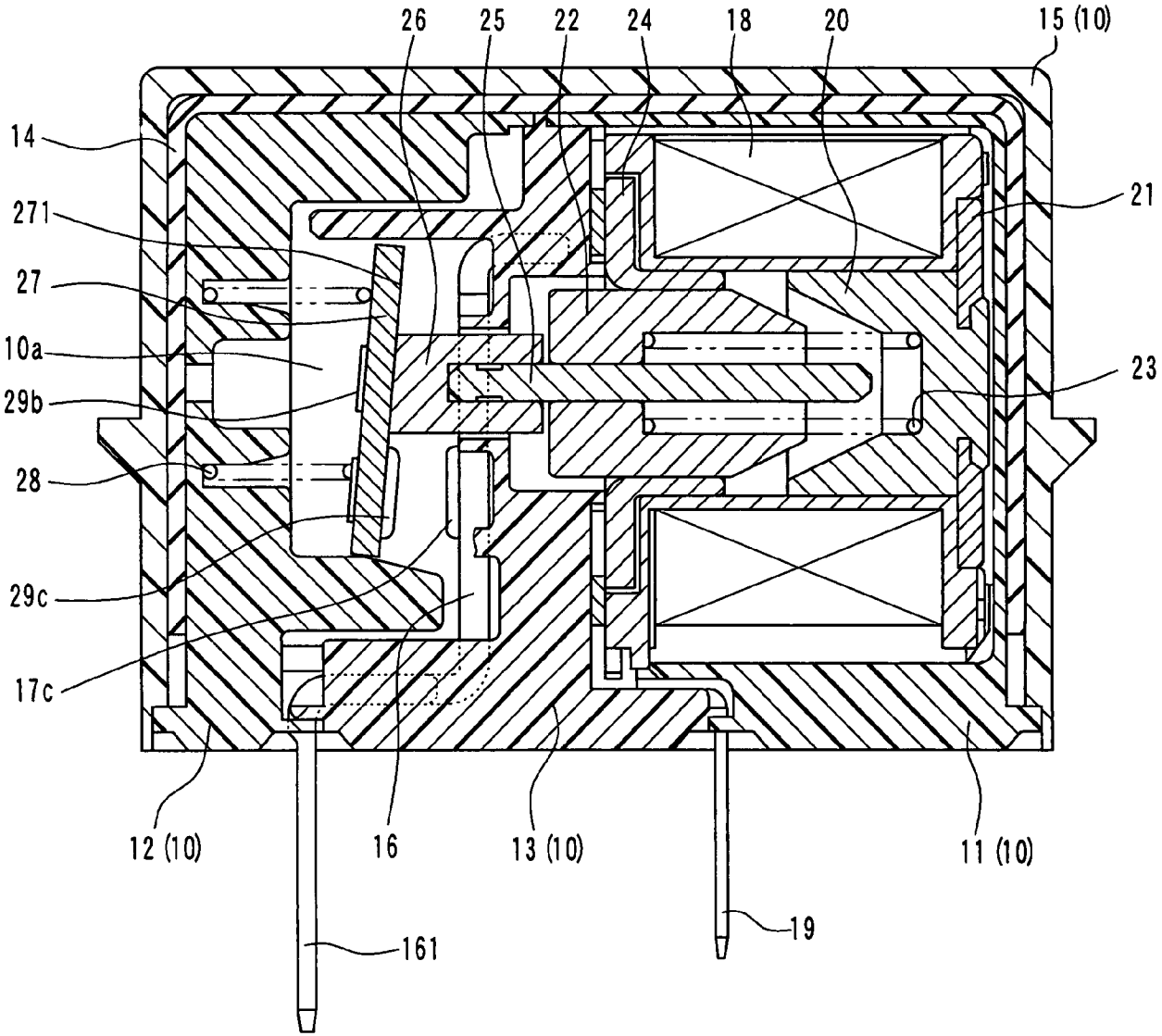
FIG. 11 is a cross-sectional view taken along the line X-X in FIG. 9 when the movable contact is separated from the fixed contact.

As a result, in a contact portion between the second fixed contact 17*b* and the second movable contact 29*b* and a contact portion between the third fixed contact 17*c* and the third movable contact 29*c*, the third movable contact 29*c* is moved away from the third fixed contact 17*c* firstly, and then, the second movable contact 29*b* is moved away from the second fixed contact 17*b* as shown in FIG. 11.

In the case where multiple fixed contacts are arranged on one fixed contact support, an arc is not generated at one contact portion, at which one movable contact is moved away from one fixed contact firstly, and an arc is generated at another contact portion, at which another movable contact is moved away from another fixed contact finally. In the electromagnetic relay of the present embodiment, an arc is not generated between the third fixed contact 17*c* and the third movable contact 29*c*, and an arc is generated between the second fixed contact 17*b* and the second movable contact 29*b*. The Lorentz force by the second permanent magnet 30*b* acts on the arc generated between the second fixed contact 17*b* and the second movable contact 29*b* reliably and appropriately, and thereby the arc can be extinguished entirely.

According to the present embodiment, when the movable core 22 and the like are driven toward the fixed core 20, the abnormal noise due to the vibration of the movable body 27 and the wear-and-tear of the contacts 17*a* to 17*c* and 29*a* to 29*c* can be restricted, as with the first embodiment.

Further, an arc is not generated at the contact portion between the third fixed contact 17*c* and the third movable contact 29*c*, on which it is difficult to act the Lorentz force by the second permanent magnet 30*b*. In contrast, the arc is generated at the contact portion between the second fixed contact 17*b* and the second movable contact 29*b*, on which the Lorentz force by the second permanent magnet 30*b* acts reliably and appropriately. Thus, the arc can be extinguished entirely.

In the third embodiment, by inclining the movable-member end surface 261 with respect to the movable-body pressing surface 271, the third movable contact 29*c* is moved away from the third fixed contact 17*c*, and then, the second movable contact 29*b* is moved away from the second fixed contact 17*b*. However, as the modified example shown in FIG. 12, the movable-member end surface 261 may be parallel to the movable-body pressing surface 271 in the contact-portion closed state, and a protrusion 272 that protrudes toward the movable-member end surface 261 may be arranged on the movable-body pressing surface 271. The protrusion 272 is located closer to the third movable contact 29*c* than the second movable contact 29*b* in the arrangement direction of the second movable contact 29*b* and the third movable contact 29*c*.

Figure 12:
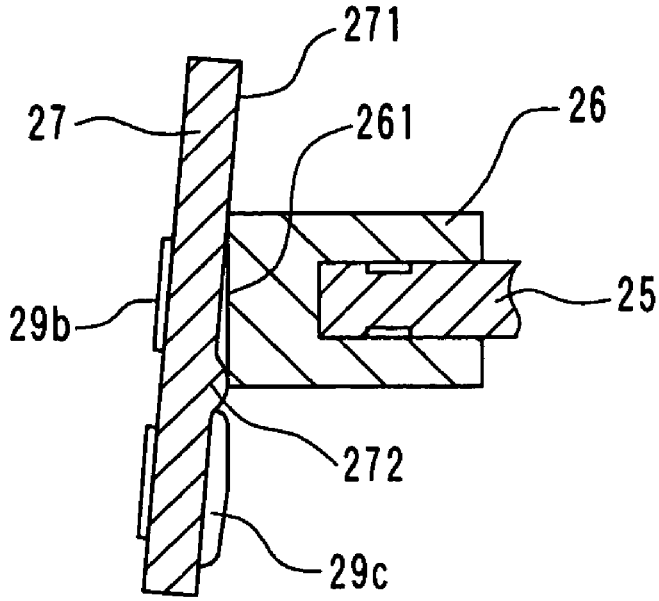
FIG. 12 is a cross-sectional view showing an electromagnetic relay according to a modified example of the third embodiment of the present invention.

In the modified example shown in FIG. 12, when the coil 18 is de-energized and the electrical insulator 26 and the like are urged toward the side away from the fixed core 20, the movable-member end surface 261 contacts the protrusion 272 of the movable-body pressing surface 271 firstly. Then, the movable-member end surface 261 presses the protrusion 272, and thereby the movable body 27 is inclined. As a result, in the contact portion between the second fixed contact 17*b* and the second movable contact 29*b* and the contact portion between the third fixed contact 17*c* and the third movable contact 29*c*, the third movable contact 29*c* is moved away from the third fixed contact 17*c* firstly, and then, the second movable contact 29*b* is moved away from the second fixed contact 17*b*.

Therefore, in the modified example shown in FIG. 12, the similar effect to the third embodiment can be obtained. Further, in the modified example shown in FIG. 12, the rotation of the electrical insulator 26 does not need to be restricted. Thus, each of the cross-sectional shape of the electrical insulator 26 and the cross-sectional shape of the opening of the guide portion 131 within the third case 13 may be a circular shape.

(Fourth Embodiment)

In the present embodiment, the three movable contacts 29*a* to 29*c* are not provided in order to reduce the manufacturing cost. Because the other configuration of the present embodiment is the same with that of the first embodiment, only the difference will be described.

Figure 13:
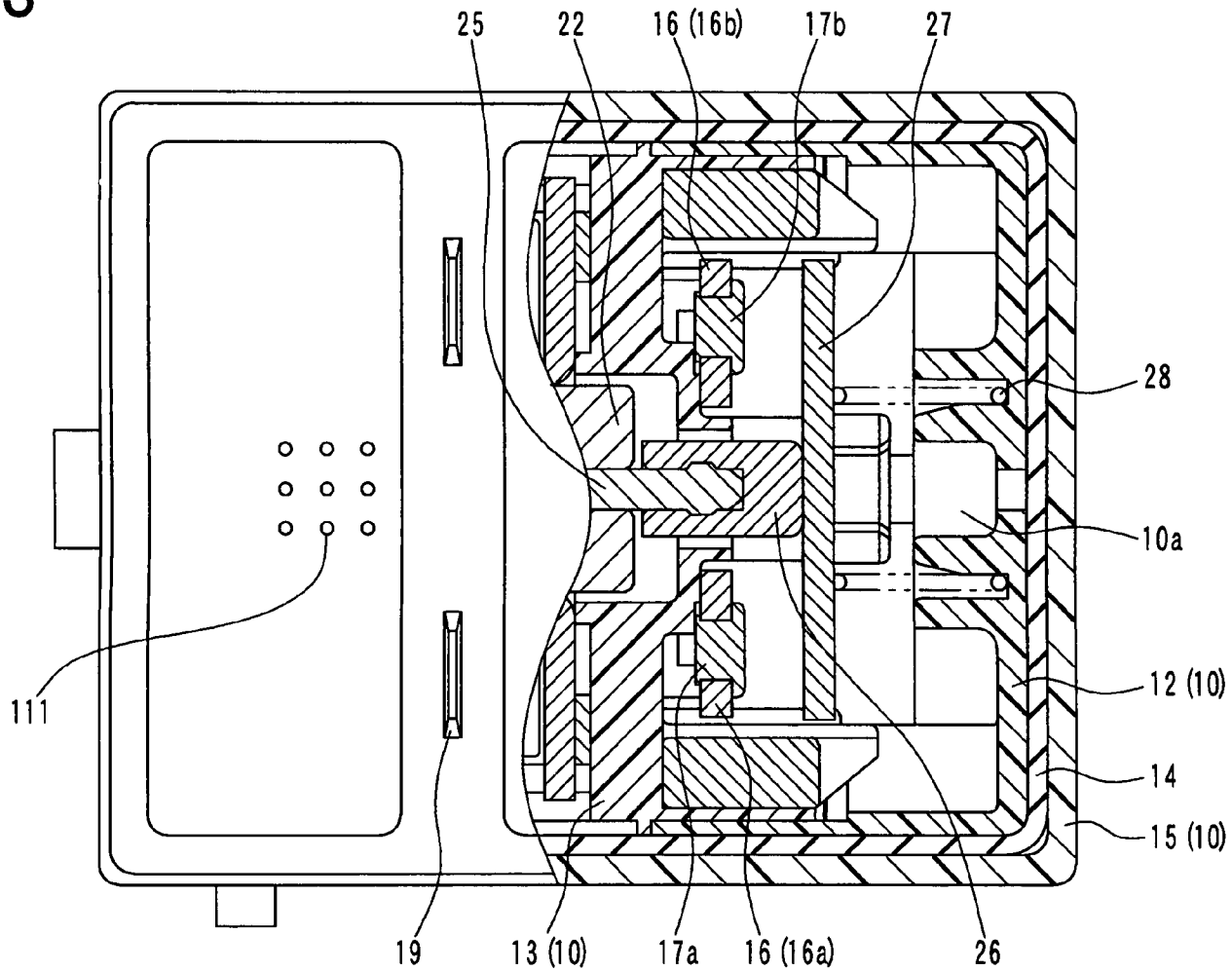
FIG. 13 is a bottom view showing a part of an electromagnetic relay according to a fourth embodiment of the present invention.

As shown in FIG. 13, the three movable contacts 29*a* to 29*c* are not provided. In contrast, the three fixed contacts 17*a* to 17*c* are fixed to the plate-like fixed contact supports 16 (regarding the third fixed contact 17*c*, refer to FIG. 5). The fixed contacts 17*a* to 17*c* protrude toward the plate-like movable body 27 from the surfaces of the fixed contact supports 16, and are configured to contact the movable body 27 by point contact.

A contact portion between the first fixed contact 17*a* and the movable body 27 corresponds to the first contact portion of the present invention. A contact portion between the second fixed contact 17*b* and the movable body 27 corresponds to the second contact portion of the present invention. A contact portion between the third fixed contact 17*c* and the movable body 27 corresponds to the third contact portion of the present invention.

The three fixed contacts 17*a* to 17*c* are arranged as described in the first embodiment. In other words, when viewed in the moving direction of the movable body 27, the third contact portion is away from the line passing through the first contact portion and the second contact portion, that is, the fixed-contact center-connecting line A.

In the present embodiment, when the coil 18 (refer to FIG. 1) is energized, the electromagnetic force attracts the movable core 22, the shaft 25 and the electrical insulator 26 toward the fixed core 20 (refer to FIG. 1) against the force of the return spring 23, and thereby the movable body 27 is urged by the pressure spring 28 so that the movable body 27 is displaced to follow the movable core 22 or the like. The movable body 27 contacts the three fixed contacts 17*a* to 17*c* by the three-points contact, thereby the vibration of the movable body 27 caused when the movable body 27 collides with the three fixed contacts 17*a* to 17*c* can be restricted. Therefore, the abnormal noise due to the vibration of the movable body 27 can be restricted.

Although the three movable contacts 29*a* to 29*c* are not provided in the present embodiment, the three fixed contacts 17*a* to 17*c* may not be provided in place of the three movable contacts 29*a* to 29*c*.

(Fifth Embodiment)

In the present embodiment, the three fixed contacts 17*a* to 17*c* and the three movable contacts 29*a* to 29*c* are not provided in order to reduce the manufacturing cost. Because the other configuration of the present embodiment is the same with that of the first embodiment, only the difference will be described.

Figure 14:
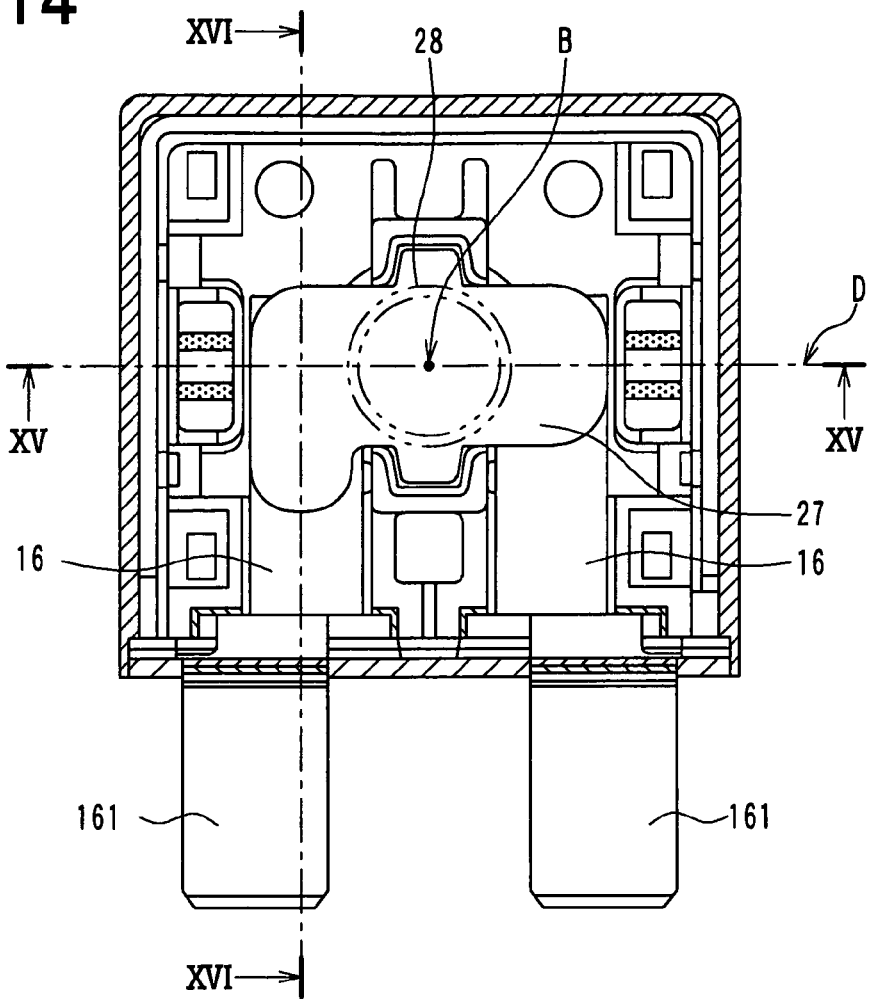
FIG. 14 is a cross-sectional view showing an electromagnetic relay according to a fifth embodiment of the present invention.
Figure 15:
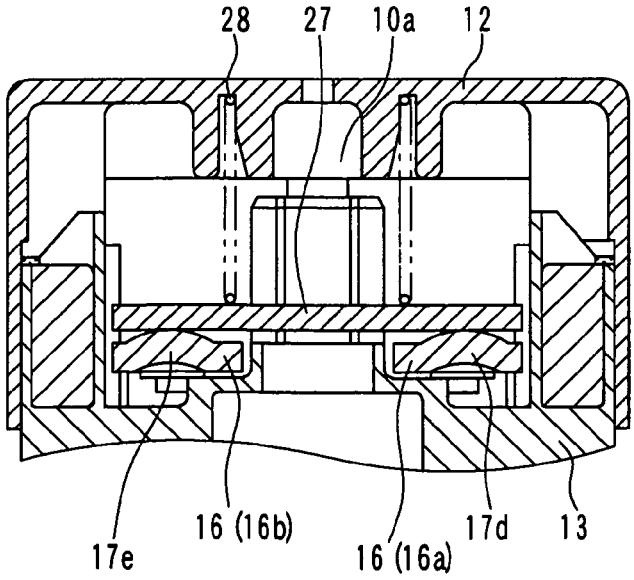
FIG. 15 is a cross-sectional view taken along a line XV-XV in FIG. 14.
Figure 16:
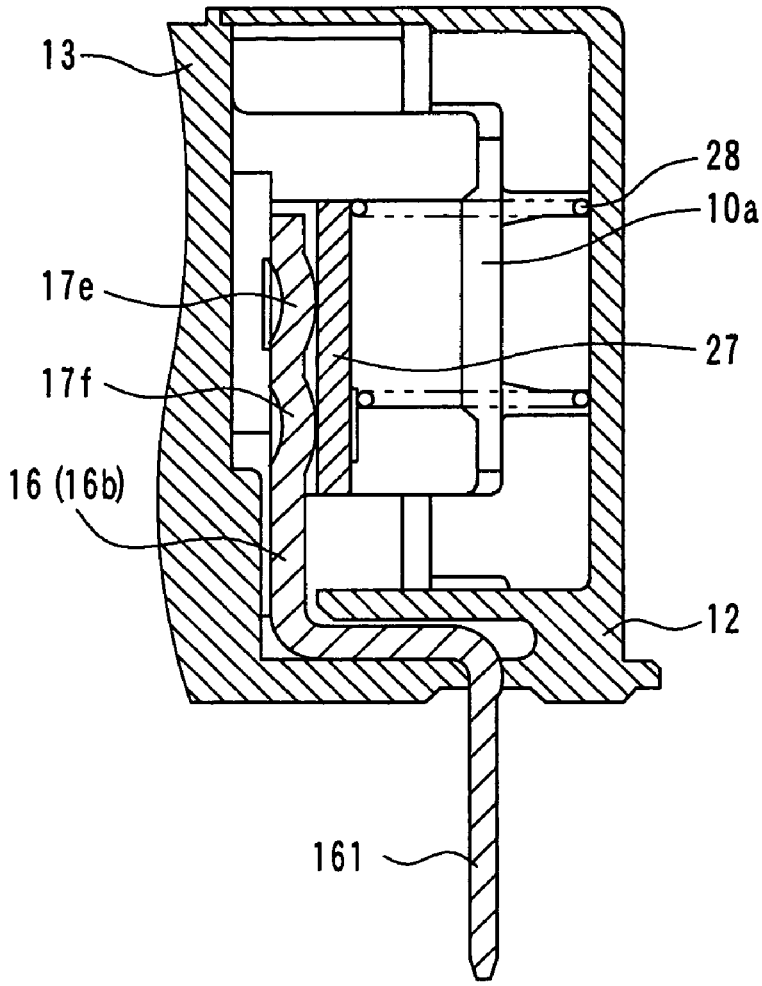
FIG. 16 is a cross-sectional view taken along a line XVI-XVI in FIG. 14.

As shown in FIGS. 14 to 16, a first fixed protrusion 17*d* that protrudes toward the plate-like movable body 27 is formed by pressing, for example, on the plate-like first fixed contact support 16*a*. A second fixed protrusion 17*e* that protrudes toward the movable body 27 and a third fixed protrusion 17*f* that protrudes toward the movable body 27 are formed by pressing, for example, on the plate-like second fixed contact support 16*b*.

The third fixed protrusion 17*f* corresponds to the fixed-side contact member of the present invention. A contact portion between the first fixed protrusion 17*d* and the movable body 27 corresponds to the first contact portion of the present invention. A contact portion between the second fixed protrusion 17*e* and the movable body 27 corresponds to the second contact portion of the present invention. A contact portion between the third fixed protrusion 17*f* and the movable body 27 corresponds to the third contact portion of the present invention.

A line passing through the center of the first fixed protrusion 17*d* and the center of the second fixed protrusion 17*e* is referred to as a fixed-protrusion connecting line D. When viewed in the moving direction of the movable body 27 (i.e., the state shown in FIG. 14), the first and second fixed protrusions 17*d*, 17*e* are arranged such that the fixed-protrusion connecting line D passes through the gravity center B of force of the pressure spring 28, which acts on the movable body 27, and the first and second fixed protrusions 17*d*, 17*e* are located on both sides of the gravity center B. Further, when viewed in the moving direction of the movable body 27, the third fixed protrusion 17*f* is arranged away from the fixed-protrusion connecting line D.

In other words, when viewed in the moving direction of the movable body 27, the third contact portion is away from a line passing through the first contact portion and the second contact portion, that is, the fixed-protrusion connecting line D.

In the present embodiment, when the coil 18 (refer to FIG. 1) is energized, the electromagnetic force attracts the movable core 22 (refer to FIG. 1), the shaft 25 (refer to FIG. 1) and the electrical insulator 26 (refer to FIG. 1) toward the fixed core 20 (refer to FIG. 1) against the force of the return spring 23 (refer to FIG. 1), and thereby the movable body 27 is urged by the pressure spring 28 so that the movable body 27 is displaced to follow the movable core 22 and the like. The three fixed protrusions 17*d* to 17*f* contact the movable body 27 by the three-points contact, thereby the vibration of the movable body 27 caused when the movable body 27 collides with the three fixed protrusions 17*d* to 17*f* can be restricted. Therefore, the abnormal noise due to the vibration of the movable body 27 can be restricted.

Although the three fixed protrusions 17*d* to 17*f* are formed on the fixed contact supports 16 in the present embodiment, three movable protrusions that protrude toward the fixed contact supports 16 may be formed on the movable body 27 without forming the three fixed protrusions 17*d* to 17*f* on the fixed contact supports 16. When viewed in the moving direction of the movable body 27, the three movable protrusions may be arranged as with the three fixed protrusions 17*d* to 17*f*.

Further, although the three fixed protrusions 17*d* to 17*f* are formed on the fixed contact supports 16 in the present embodiment, one protrusion may be formed on one of the fixed contact supports 16 and the movable body 27 and the other two protrusions may be formed on the other of the fixed contact supports 16 and the movable body 27.

Other Embodiments

In the first, second and fourth embodiments, the third fixed contact 17*c* and the third movable contact 29*c* are made of conductive metal and are used as the contacts. However, because the third fixed contact 17*c* and the third movable contact 29*c* do not need to be used as the contacts, the third fixed contact 17*c* and the third movable contact 29*c* may be made of nonconductive metal.

Further, in the first, second and fourth embodiments, the third fixed contact 17*c* as the fixed-side contact member is fixed to one of the fixed contact supports 16. However, the third fixed contact 17*c* as the fixed-side contact member may be provided within the third case 13. In this case, because the third fixed contact 17*c* is not used as the contact, the third fixed contact 17*c* can be formed integrally with the third case 13 made of resin.

In the above embodiments, although one pressure spring 28 is used, multiple pressure springs may be used.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An electromagnetic relay comprising:

a case;

a coil configured to generate an electromagnetic force when the coil is energized;

a movable member movable in a direction parallel to an axial direction of the coil;

a plate-shaped first fixed contact support having a first fixed contact;

a plate-shaped second fixed contact support having a second fixed contact;

a plate-shaped movable body configured to contact and be separated from the first and second fixed contact supports, the movable body having first and second planar surfaces substantially perpendicular to the axial direction of the coil;

a pressure spring in contact with the first planar surface of the movable body and configured to urge the movable body such that the movable body contacts the first and second fixed contact supports; and a return spring configured to urge the movable body via the movable member such that the movable body is separated from the first and second fixed contact supports, wherein the movable body contacts the first fixed contact at a first contact portion, and the movable body contacts the second fixed contact at a second contact portion, when the movable member is driven by the electromagnetic force of the coil, the second fixed contact support further has a third fixed contact, the movable body contacts the third fixed contact by a point contact when the movable body contacts the first and second fixed contacts, the first and second fixed contact supports are fixed to the case, one end of each of the first and second fixed contact supports is located in a housing space formed in the case, the second and third fixed contacts are integrally formed on the one end of the second fixed contact support and spaced from each other in a lengthwise direction of the second fixed contact support, the movable member and the pressure spring are substantially coaxial with each other and are arranged on opposite sides of the movable body, the movable member contacts the second planar surface of the movable body to urge the second planar surface in the coaxial direction and to drive the movable member against resilience of the pressure spring thereby separating from the first fixed contact, the second fixed contact and the third fixed contact, when the coil is de-energized, and the movable member separates from the second planar surface of the movable body in the coaxial direction thereby causing the movable body to contact the first fixed contact, the second fixed contact, and the third fixed contact by resilience of the pressure spring, when the coil is energized.

2. The electromagnetic relay according to claim 1, wherein the first fixed contact is fixed to the first fixed contact support, the second fixed contact is fixed to the second fixed contact support, and the movable body contacts the first and second fixed contacts by the point contact.

3. The electromagnetic relay according to claim 1, wherein the first movable contact is fixed to the movable body, the second movable contact is fixed to the movable body, and the first movable contact contacts the first fixed contact support by the point contact and the second movable contact contacts the second fixed contact support by the point contact.

4. The electromagnetic relay according to claim 1, further comprising:

a first fixed protrusion arranged on the first fixed contact support; and a second fixed protrusion arranged on the second fixed contact support, wherein the movable body contacts the first and second fixed protrusions by the point contact.

5. The electromagnetic relay according to claim 1, further comprising:

a first movable protrusion arranged on the movable body; and a second movable protrusion arranged on the movable body, wherein the first movable protrusion contacts the first fixed contact support by the point contact and the second movable protrusion contacts the second fixed contact support by the point contact.

6. The electromagnetic relay according to claim 1, further comprising:

first and second external terminals connected with the first and second fixed contact supports respectively and connected to an external device, and the second and third fixed contacts are arranged along the lengthwise direction of the second fixed contact support.

7. The electromagnetic relay according to claim 1, wherein the movable member includes a shaft and an electrical insulator, the electrical insulator having an electrical insulation property and fixed to one end portion of the shaft, and the electrical insulator has one end having a planar surface configured to contact the second planar surface of the movable body.

* * * * *